US012280921B2

(12) United States Patent
Khattar et al.

(10) Patent No.: US 12,280,921 B2
(45) Date of Patent: Apr. 22, 2025

(54) HINGED CLOSURE

(71) Applicant: SIDEL PARTICIPATIONS SAS, Octeville-sur-Mer (FR)

(72) Inventors: Sanjeev Khattar, Brampton (CA); Stephane Graux, Liergues (FR)

( * ) Notice: Subject to any disclaimer, the term of this patent is extended or adjusted under 35 U.S.C. 154(b) by 0 days.

(21) Appl. No.: 16/998,315

(22) Filed: Aug. 20, 2020

(65) Prior Publication Data

US 2022/0055804 A1 Feb. 24, 2022

(51) Int. Cl.
*B65D 47/08* (2006.01)
*B65D 55/16* (2006.01)

(52) U.S. Cl.
CPC ..... *B65D 47/0838* (2013.01); *B65D 55/16* (2013.01); *B65D 2251/04* (2013.01); *B65D 2251/1083* (2013.01)

(58) Field of Classification Search
CPC ..... B65D 2251/1008; B65D 2251/10; B65D 41/3428; B65D 47/0814; B65D 55/16; B65D 55/165; B65D 2401/20; B65D 2401/30; B65D 47/0838; B65D 2251/04; B65D 2251/1083; B65D 47/0809; B65D 47/0828; B65D 47/0823
USPC ..... 215/235, 252, 237; 222/517
See application file for complete search history.

(56) References Cited

U.S. PATENT DOCUMENTS 1,743,520 A * 1/1930 Baron ..... A47F 3/145 215/235
2,753,051 A * 7/1956 Tupper ..... B65D 47/148 220/259.2
2,960,254 A * 11/1960 Kiba ..... E05D 7/1077 220/840
3,441,161 A * 4/1969 Van Baarn ..... B65D 41/0421 D9/446
3,747,796 A * 7/1973 Kneier ..... B65D 43/163 206/811
4,158,902 A * 6/1979 Chernack ..... B65D 47/0819 220/838
4,727,999 A * 3/1988 Gach ..... B65D 47/103 215/254
4,807,771 A * 2/1989 Roy ..... B65D 41/3433 215/252
4,813,560 A * 3/1989 Begley ..... B65D 47/0814 220/838
5,040,691 A * 8/1991 Hayes ..... B65D 50/061 215/206
5,065,911 A * 11/1991 Rohr ..... B65D 47/0861 215/238
5,257,708 A * 11/1993 Dubach ..... B65D 47/0814 220/838

(Continued)

FOREIGN PATENT DOCUMENTS

WO 2019192714 A1 10/2019

*Primary Examiner* — Steven A. Reynolds
*Assistant Examiner* — Prince Pal
(74) *Attorney, Agent, or Firm* — Blake T. Hudson; Stephanie L. Davy-Jow

(57) ABSTRACT

Hinged closures for containers are provided. The hinged closures allow for a closure that can be held in the open position with a large opening angle. The hinged closures include a lid portion and a skirt portion interconnected by a hinge portion. The hinge portion can be formed from two connecting columns and a central tongue, or two tongues and a central connecting column.

19 Claims, 16 Drawing Sheets

(56) References Cited

U.S. PATENT DOCUMENTS 5,386,918 A * 2/1995 Neveras ..... B65D 47/0838 215/254
5,423,442 A * 6/1995 Nozawa ..... B65D 47/0814 220/838
5,435,456 A * 7/1995 Dubach ..... B65D 47/0814 220/838
5,450,972 A * 9/1995 Zemlo ..... B65D 41/3447 215/318
5,497,906 A * 3/1996 Dubach ..... B65D 47/0838 215/241
5,501,348 A * 3/1996 Takeuchi ..... B65D 47/0828 220/827
5,501,349 A * 3/1996 McCandless ..... B65D 41/3442 215/252
5,540,343 A * 7/1996 Schumacher ..... B65D 47/0814 220/838
5,605,240 A * 2/1997 Guglielmini ..... B65D 51/16 215/256
5,725,115 A * 3/1998 Bosl ..... B65D 55/16 215/258
5,735,418 A * 4/1998 Erb ..... B65D 47/0819 220/254.5
5,735,419 A * 4/1998 Ma ..... B65D 47/0804 215/256
5,740,932 A * 4/1998 Battegazzore ..... B65D 41/3404 215/334
5,762,216 A * 6/1998 Takeuchi ..... B65D 47/0809 215/235
5,769,253 A * 6/1998 Gross ..... B65D 47/0814 215/237
5,785,193 A * 7/1998 Kobayashi ..... B65D 47/0814 215/237
5,860,387 A * 1/1999 Giveen ..... A61F 9/0008 206/277
5,884,788 A * 3/1999 Wilde ..... B65D 51/1688 215/349
5,908,126 A * 6/1999 Wang ..... B65D 47/305 220/837
5,913,435 A * 6/1999 Fuchs ..... B65D 47/0814 215/237
5,913,437 A * 6/1999 Ma ..... B65D 41/3428 215/329
6,000,550 A * 12/1999 Simpson ..... H01L 21/67386 16/257
6,041,477 A * 3/2000 Rentsch ..... B65D 47/0814 16/225
6,170,683 B1 * 1/2001 Montgomery ..... B65D 41/3442 220/291
6,253,937 B1 * 7/2001 Anderson ..... B65D 47/0838 215/256
6,419,101 B1 * 7/2002 Hessel ..... B65D 47/141 222/541.6
6,474,491 B1 * 11/2002 Benoit-Gonin ..... B65D 41/3428 220/263
6,520,370 B2 * 2/2003 Nyman ..... B65D 41/48 215/235
6,786,447 B2 * 9/2004 Geib ..... A47K 10/3818 242/588.3
7,051,888 B2 * 5/2006 Antier ..... B65D 47/0804 220/831
7,314,150 B2 * 1/2008 Skillin ..... B65D 47/0828 220/837
8,079,484 B2 * 12/2011 Wachsberg ..... B65D 47/0842 220/837
8,256,643 B2 * 9/2012 Uytterhaeghe ..... B65D 47/0814 220/254.1
8,292,110 B2 * 10/2012 Rutter ..... B65D 47/0838 220/817
8,413,832 B2 * 4/2013 Mazurkiewicz ..... B65D 55/024 215/253
8,523,025 B2 * 9/2013 Skillin ..... B65D 47/0809 222/546
8,708,175 B2 * 4/2014 Smith ..... B65D 47/0809 220/254.5
8,794,460 B2 * 8/2014 Druitt ..... B65D 50/061 220/345.2
9,821,934 B2 * 11/2017 Bevan ..... B65D 41/3428
9,884,705 B2 * 2/2018 Wood ..... B65D 41/0421
9,884,706 B1 * 2/2018 Skillin ..... B65D 47/32
11,040,806 B2 * 6/2021 Naumann ..... B65D 41/485
2002/0066713 A1 * 6/2002 Ma ..... B65D 41/3428 215/252
2002/0096532 A1 * 7/2002 Berge ..... B65D 47/0819 220/831
2003/0102280 A1 * 6/2003 Odet ..... B65D 41/3428 215/252
2003/0192853 A1 * 10/2003 Zapata ..... B65D 41/3428 215/252
2004/0040928 A1 * 3/2004 Noonan ..... B65D 41/3447 215/258
2004/0060891 A1 * 4/2004 Nishida ..... B65D 41/3438 215/252
2004/0069738 A1 * 4/2004 Orth ..... B65D 41/3447 215/252
2004/0178166 A1 * 9/2004 Antier ..... B65D 47/0804 215/235
2005/0040131 A1 * 2/2005 Lin ..... B65D 55/16 215/254
2006/0032831 A1 * 2/2006 Major ..... B29C 43/18 215/350
2006/0163188 A1 * 7/2006 Lagler ..... B65D 47/0809 220/254.5
2006/0273062 A1 * 12/2006 Delage ..... B65D 47/0814 220/254.5
2007/0095864 A1 * 5/2007 Vangeel ..... B65D 47/0871 222/111
2007/0241075 A1 * 10/2007 Skillin ..... B65D 55/0818 215/253
2007/0251911 A1 * 11/2007 Russell ..... B65D 41/0414 215/344
2008/0105642 A1 * 5/2008 Bassi ..... B65D 5/746 215/253
2008/0169261 A1 * 7/2008 Druitt ..... B65D 47/0809 215/253
2008/0203106 A1 * 8/2008 Uytterhaeghe ..... B65D 47/0814 220/838
2008/0283484 A1 * 11/2008 Michalsky ..... B65D 15/08 215/235
2009/0159552 A1 * 6/2009 Cano-Pey ..... B65D 47/0828 215/237
2009/0294447 A1 * 12/2009 Mazurkiewicz ..... B65D 47/0819 220/288
2010/0005641 A1 1/2010 Smith
2010/0127021 A1 * 5/2010 Schantz ..... B65D 47/0838 222/498
2010/0140268 A1 * 6/2010 Lohrman ..... B65D 47/103 220/270
2011/0100950 A1 * 5/2011 Graux ..... B65D 51/1661 215/355
2011/0114593 A1 * 5/2011 Ishii ..... B65D 41/325 215/253
2012/0043295 A1 * 2/2012 Webster ..... B65D 47/06 215/44
2012/0205377 A1 * 8/2012 Adler ..... B65D 55/16 220/254.3
2012/0241480 A1 * 9/2012 Hindle ..... B65D 47/08 222/541.9
2013/0001185 A1 * 1/2013 Antier ..... B65D 55/16 215/253
2013/0043207 A1 * 2/2013 Luzzato ..... B65D 41/0485 215/252
2014/0263149 A1 * 9/2014 Berge ..... B65D 41/3423 215/44
2014/0263335 A1 * 9/2014 Taber ..... B65D 41/0421 220/276
2015/0298870 A1 * 10/2015 Graux ..... B65D 41/3428 215/252

(56) References Cited

U.S. PATENT DOCUMENTS

2015/0353242 A1* 12/2015 Santarelli ..... B65D 43/163 383/42
2015/0353245 A1* 12/2015 Sakimura ..... B65D 47/2081 222/545
2015/0375908 A1* 12/2015 Rognard ..... B65D 47/2031 215/235
2016/0101914 A1* 4/2016 Logel ..... B65D 51/244 220/214
2016/0137365 A1* 5/2016 Gonzalez Sanchez ..... B65D 43/166 220/319
2016/0176586 A1* 6/2016 Mélan-Moutet ..... B65D 41/325 215/252
2018/0086510 A1* 3/2018 Berroa Garcia ..... B65D 47/08
2018/0118418 A1* 5/2018 Nakamura ..... B65D 41/3428
2018/0118423 A1* 5/2018 Bois ..... B65D 47/0809
2018/0170625 A1* 6/2018 Sung ..... B65D 41/34
2018/0237190 A1* 8/2018 Iwasaki ..... B65D 55/16
2018/0297752 A1* 10/2018 Mai ..... B65D 51/1688
2019/0039787 A1* 2/2019 Benoit-Gonin ..... B65D 41/485
2019/0231984 A1* 8/2019 Mahmoodian ..... A61M 5/3134
2019/0344933 A1* 11/2019 Kim ..... B65D 55/16
2019/0375557 A1* 12/2019 Lutton ..... B65D 41/3428
2020/0207525 A1* 7/2020 Sung ..... B65D 43/0231
2020/0369446 A1* 11/2020 Mélan-Moutet ... B65D 41/3447
2020/0377268 A1* 12/2020 Naumann ..... B65D 41/485
2020/0399036 A1* 12/2020 Dai ..... B65D 41/325
2020/0407124 A1* 12/2020 Caszatt ..... B65D 47/0838
2021/0039841 A1* 2/2021 Pucci ..... B65D 55/06
2021/0094733 A1* 4/2021 Bloom ..... B65D 41/3442
2021/0107709 A1* 4/2021 Garcia Alberola .... B65D 41/34
2021/0163190 A1* 6/2021 Berroa Garcia ..... B65D 51/242
2021/0206537 A1* 7/2021 Lamoureux ..... B65D 55/16
2021/0229873 A1* 7/2021 Berroa García ... B65D 41/3447
2021/0300648 A1* 9/2021 Bassi ..... B65D 41/34
2021/0316908 A1* 10/2021 Lamoureux ..... B65D 55/16
2021/0347533 A1* 11/2021 Lenz ..... B65D 55/16
2021/0354883 A1* 11/2021 Ferrari ..... B65D 41/485
2021/0371168 A1* 12/2021 Graux ..... B65D 41/3409
2023/0042976 A1* 2/2023 Kainz ..... B65D 55/16

* cited by examiner

100

100

100

100

100

100

100

100

100

100

200

200

400

400

500

500

HINGED CLOSURE

FIELD OF INVENTION

The present invention relates to bottle closures for containers. More particularly, the invention relates to hinged bottle closures.

BACKGROUND

Hinged closures that can remain open are needed for various uses such as in conjunction with containers used to house carbonated and non-carbonated beverages, water or other liquids, powders, oils, condiments, and beauty products, among others. Existing closures sacrifice desirable characteristics, such as opening angle range, flexibility, inability to tether to a corresponding container, and the presence of a locking mechanism.

SUMMARY

The present disclosure relates to hinged closures for a container, such as for a beverage. The hinged closures allow for a closure that can be held in the open position with a large opening angle. The closure can include an upper lid portion, a lower skirt portion, and a hinge portion. The hinge portion integrally interconnects the lid portion and the skirt portion and Includes at least one connecting column and at least one tongue. The hinge portion rotates the lid portion relative to the skirt portion such that the lid portion can open greater than 180 degrees from a closed position.

In one aspect the hinge portion comprises two connecting columns adjacent to one another and one tongue placed parallel between the two connecting columns.

In another aspect, the hinge portion comprises two tongues parallel to one another and one connecting column placed parallel between the two tongues.

These and other aspects of the present disclosure will be discussed in more detail as set forth below.

BRIEF DESCRIPTION OF THE DRAWINGS

Further aspects of the present disclosure will be more readily appreciated upon review of the detailed description of its various embodiments, described below, when taken in conjunction with the accompanying drawings.

FIG. 1A shows a perspective view; FIG. 1B provides a side view including the hinge portion; FIG. 1C is cross-sectional perspective view through a connecting column; FIG. 1D is a cross-sectional perspective view through the tongue; FIG. 1E shows a side cross-sectional view of the hinged closure tethered to a container's neck in the open position.

FIG. 1M is a cross-section view.

FIG. 2A shows a perspective view; FIG. 2B provides a side view including the hinge portion; FIG. 2C is cross-sectional perspective view through a connecting column; FIG. 2D is a cross-sectional perspective view through the tongue.

FIGS. 2H and 21 are top perspective views of the closure shown in FIG. 2E, with and without the container, respectively.

FIG. 4A shows a perspective view; FIG. 4B provides a side view including the hinge portion; FIG. 4C is cross-sectional perspective view through a connecting column; FIG. 4D is a cross-sectional perspective view through the tongue.

FIG. 5A shows a perspective view; FIG. 5B provides a side view including the hinge portion; FIG. 5C is cross-sectional perspective view through a connecting column; FIG. 5D is a cross-sectional perspective view through a tongue.

Figure 1A:
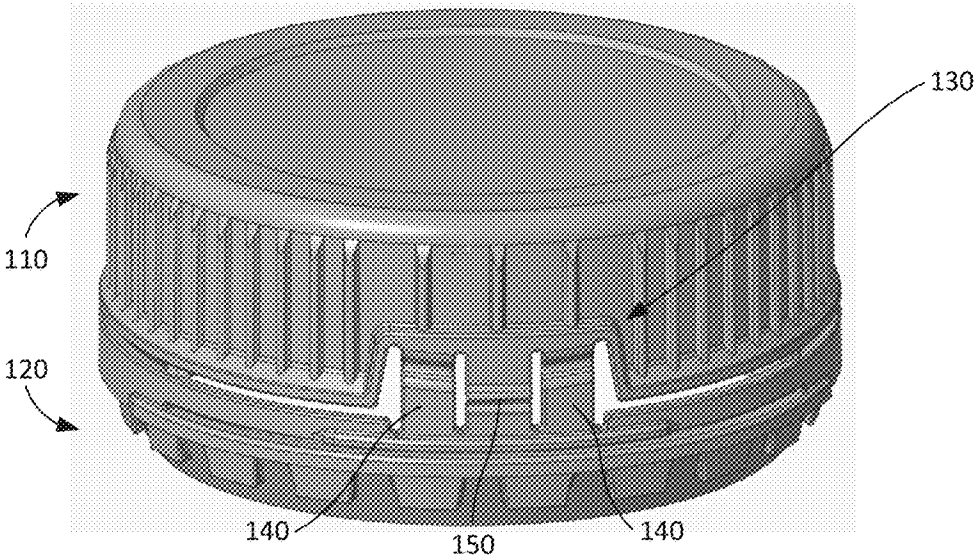
FIGS. 1A-1E provide an example of a hinged closure from various views in accordance with embodiments of the present disclosure, wherein the hinge portion comprises two connecting columns and a central tongue.

The drawings illustrate only example embodiments and are therefore not to be considered limiting of the scope described herein, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions may be exaggerated to help visually convey certain principles. In the drawings, similar reference numerals between figures designate like or corresponding, but not necessarily the same, elements.

DETAILED DESCRIPTION

In accordance with the purpose(s) of the present disclosure, as embodied and broadly described herein, embodiments of the present disclosure, in some aspects, relate to hinged closures for containers having an opening. In general, embodiments of the present disclosure provide for hinged closures and methods of making hinged closures. For instance, the hinged closure described herein are generally used in connection with containers for dispensing products such as food and beverages (e.g. carbonated and non-carbonated beverages, water, oils or condiments, powders or granular products such as seasonings), beauty products (e.g. shampoos, lotions), and household products (e.g. adhesives, detergents). But the hinged closure of the present disclosure can also be used in connection with various other containers as desired. The hinged closure can be adapted for container applications having a screw closure and/or a snap closure, and in use with all applications, the hinged closure can be locked in the open position and can have an opening angle of up to 180 degrees or more. Additionally, the hinged closures described herein advantageously provide for flexibility, tamper evidence, and evidence of tampering.

The present disclosure includes several embodiments of hinged closures with at least one substantially H-shaped hinge portion within the closure, as shown in the figures. For instance, FIGS. 1A-1D illustrate one example of a hinged closure 100. The hinged closures in general comprise an upper lid portion (or closure shell) 110 and a lower skirt portion 120 which are integrally interconnected by the H-shaped hinge portion 130. The skirt portion is generally ring shaped and can include a tamper evident band. The H-shaped hinge portion includes at least one connecting column 140 and at least one tongue 150. In some embodiments, the hinge portion can comprise two connecting columns and having a tongue placed parallel between the two connecting columns 140. In some embodiments, the connecting columns are vertical and thus are parallel to one another. In other embodiments, at least a portion of the connecting columns are curved with respect to one another (e.g., crescent shaped).

In some embodiments, the hinge portion can comprise two tongues 150 parallel to one another and having a connecting column 140 placed parallel between the two tongues 150. The hinge portion is positioned on the lid portion 110 such that it is perpendicular to the top of the lid portion when the closure is in a closed position. The connecting columns 140 are oriented along the curvature of the skirt.

Each of the connecting columns 140 can have at least one line of articulation (or a living hinge) 145 that forms a joint at which the connecting column pivots and/or rotates relative to the skirt portion such that the lid portion can open greater than 180 degrees from the closed position. The line of articulation 145 enables the upper lid portion 110 to be pivotable relative to the tamper evident band.

In general, the line of articulation 145 is either horizontal (e.g., zero degrees) to the long axis of the column or angled with respect to the long axis of the column. An angled line of articulation 145 can allow for the redirection of stress, such that when opening the hinged closure 100 the lateral portion of the connecting columns 140 receives the initial stress, allowing for the H-shaped hinge portion 130 to withstand more force than with a horizontal line of articulation. The line of articulation can, for example, have an angle of about 1 to 45 degrees practically, about 5 to 30 degrees preferably, or about 5 to 15 degrees ideally. In some embodiments, a single line of articulation can be located in the upper portion of the connecting column. In other embodiments, the line of articulation can be located at the middle of the column. In yet other embodiments, a line of articulation can be located at both the upper and lower portions of the connecting column. In various embodiments, the line of articulation can include a groove or be slightly tapered at the point of articulation to provide a pinch area.

The tongue comprises a top tongue portion 151 and a bottom tongue portion 152. The top portion is integrally joined to the lid portion, and the bottom portion is integrally joined to the skirt portion. The top portion and the bottom portion are separated by an opening (also referred to as a cut). In some embodiments, the portions 151 and 152 are joined using breakable bridges (not shown) that disconnect upon initial opening of the container.

In some embodiments, one of the tongue portions can include a protrusion configured to engage with the other tongue portion when opening to hold the lid in the open position. In other embodiments, the tongue can include a protrusion configured to engage with the container to hold the lid in the open position, such as engaging with the screw threads on the container neck or between the support ring and the tamper evident ring of the container neck. In some embodiments, the skirt portion can include a horizontal slit 180 below the tongue to allow more bending. Additional reinforcement of material (e.g., slit reinforcement 185) on top of the horizontal slit 180 can also be included as desired.

In some embodiments (not shown), only the top tongue portion 151 is present. In these embodiments, the top tongue portion 151 engages with the container neck (e.g., screw threads) to hold the lid in the open position. The top tongue portion 151 can be joined directly to the skirt portion 120 using breakable bridges that disconnect upon initial opening of the container. In some embodiments, the top tongue portion 151 is dimensioned such as to reduce any spacing that would exist between the upper tongue portion of the skirt 120.

In various embodiments, the hinged closure can be formed using injection molding and can have various features suitable to efficient injection molding manufacture. In some embodiments, the hinged closure can include vertical openings alongside the hinge portion. Advantageously, the openings act as a split between the slide and the cavity of the injection mold, allowing the slide of the injection mold to follow the opening. In other embodiments, the openings alongside the hinge portion can be angled. The angled opening allows for improved flexibility of the hinge and can be tapered to prevent undercutting during molding. The removal of undercutting reduces the potential for damage when removing the closure from the mold, thereby reducing wastage and costs. In some embodiments, the closure can be molded as a single piece. No subsequent slitting operations are required to form the openings and/or voids (e.g. the openings alongside the hinge portion, between the connecting columns and tongue, and the bottom slit). The parting line is located to ensure plastic is not included in the void areas during molding, in areas other than the location of the H-shaped portion(s) of the hinge. In other embodiments, the closure can include vertical knurls (or ribs). The knurls can provide additional strength to the closure and provide a grip surface for a user. When manufactured using injection molding, the split line between the slide and cavity can be such that knurls that are located on the hinge area will partially be molded by the slide to prevent undercutting.

As previously mentioned, the closures described herein can be screw closures or snap closures. When configured as a snap closure, horizontal slit 180 can be omitted. When configured as a screw closure, screw threads can be located on an interior surface of the upper lid portion 110. In either configuration, the closures can be from about 16 mm to about 110 mm, preferably 25 mm to 48 mm in diameter (e.g., for the beverage industry) or can alternatively be sized larger as desired to accommodate containers of various sizes. In example commercial embodiments, such as in a beverage container closure, the hinge can withstand a break force of about 25N. However, in other embodiments, the hinge can be designed to withstand higher or lower break forces depending on various factors, such as the size of the container, the desired level of break force for a particular application, the required level of reusability, etc. The closure can also include locking means on the interior portion, such as ratchet (or lug) segments, laterally spaced apart a distance suitable to be engaged with the neck of the container. In some embodiments, the tamper evident band can include one or more beads molded into and positioned on the internal surface of the tamper evident band configured to engage the tamper evident ring of the container neck. Moreover, although the closures described and shown herein are substantially circular, in other embodiments the hinged closure could be ovoid, polygonal, or other shape to accommodate a variety of containers.

The skirt portion can include tamper evident bands or other tamper-prevention means such as frangible bridges, which would be understood by one of ordinary skill in the art. Said bridges can be added during primary cut (i.e., between the lid portion 110 and tamper evident band) and/or a secondary cut (i.e., positioned within the tamper evident band).

The hinged closures and methods of making described herein pertain primarily to plastic closures formed by injection molding. Such materials generally include thermoplastic and thermosetting polymers. However, other materials including elastomers, flexible metals, or other materials suitable for injection molding can be envisioned by one of ordinary skill in the art. Similarly, the hinged closures described herein could be manufactured using other methods including but not limited to compression molding and/or additive manufacturing.

Figure 1B:
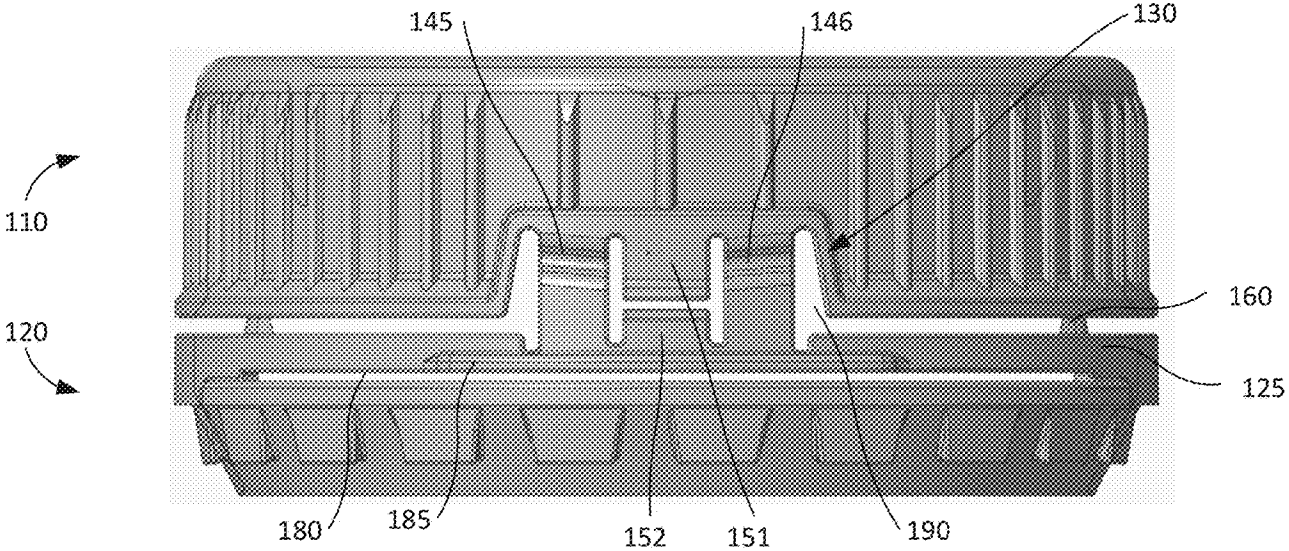
Figure 1C:
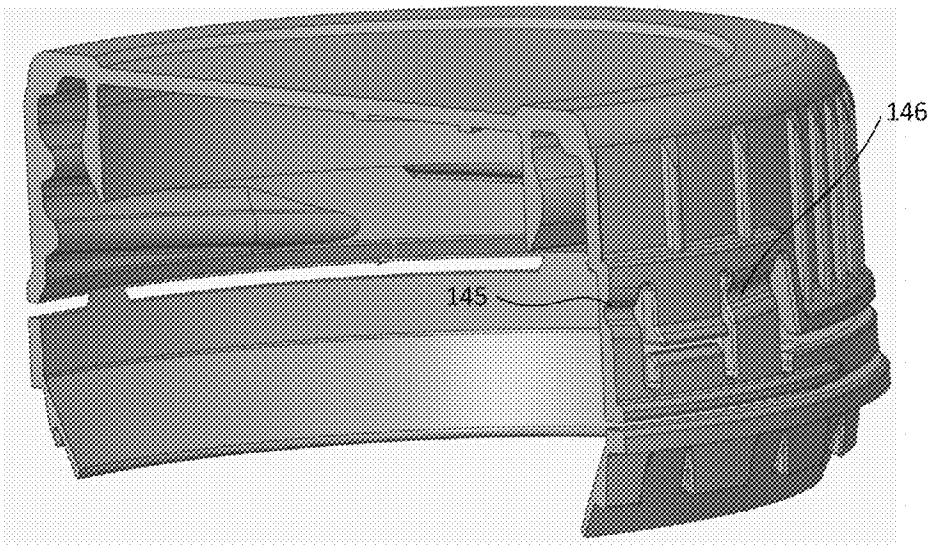
Figure 1D:
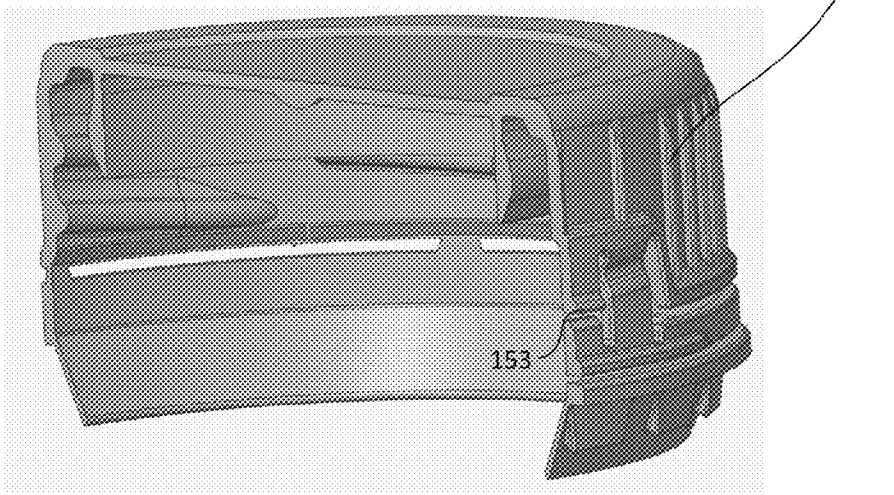
Figure 1E:
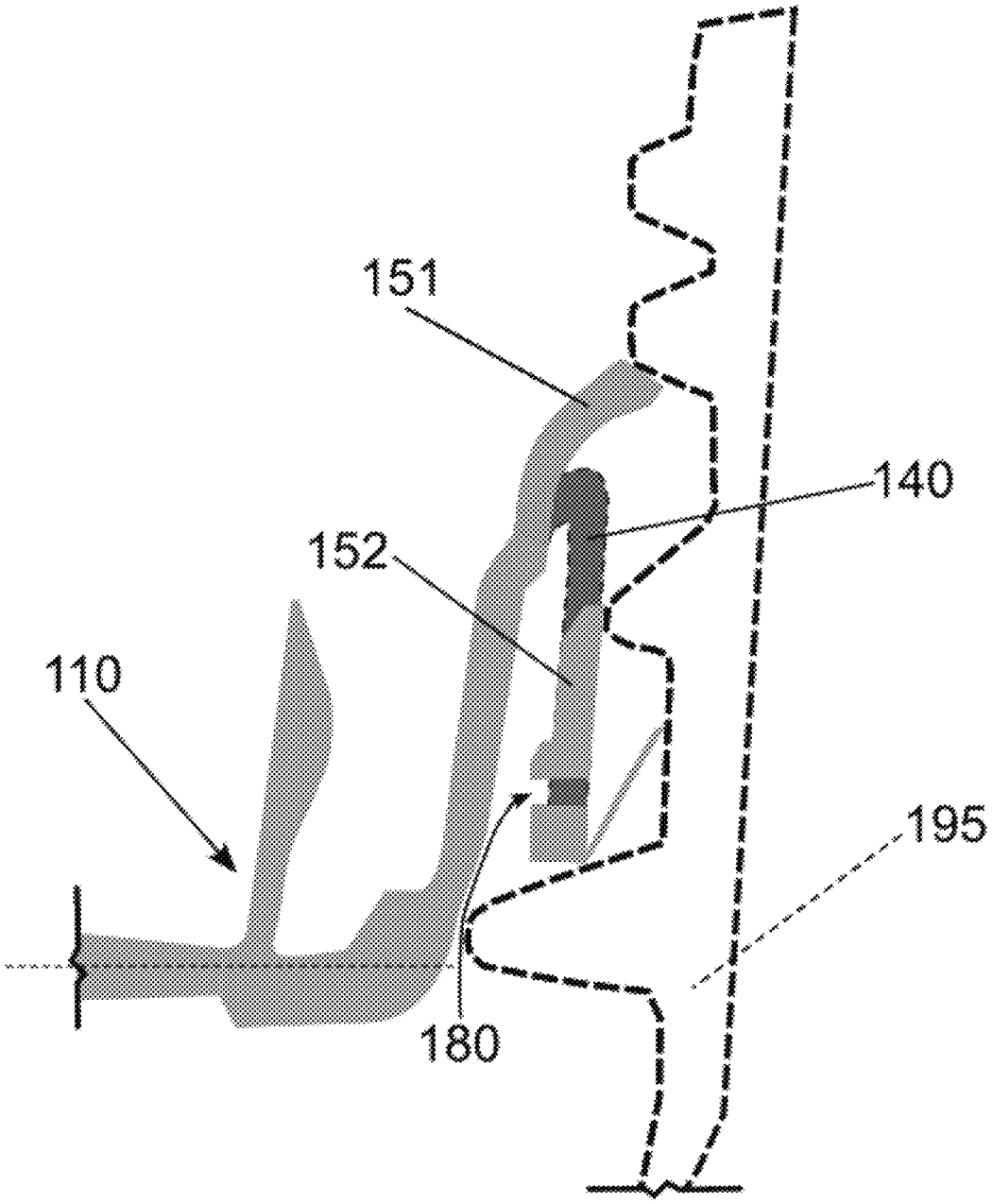
Figure 1F:
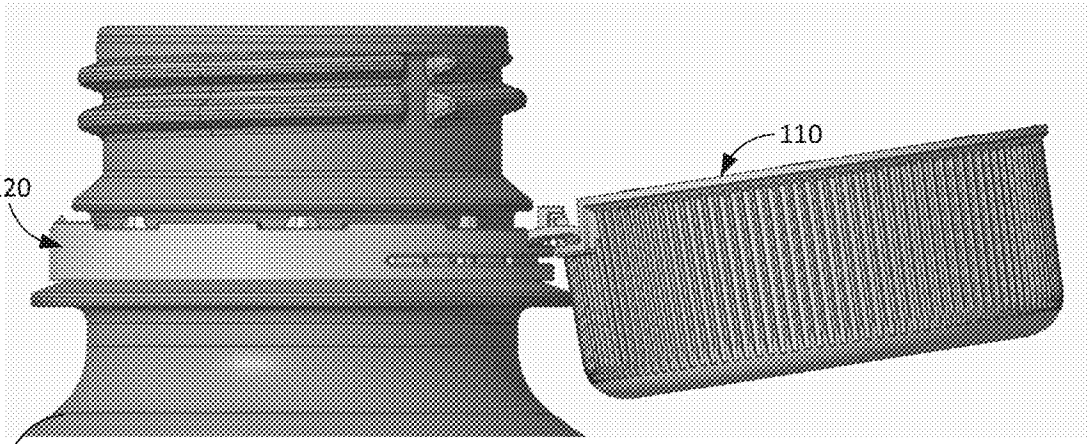
FIG. 1F is a side view of an embodiment of the present disclosure in which the hinged closure in the open position and attached to a container.
Figure 1G:
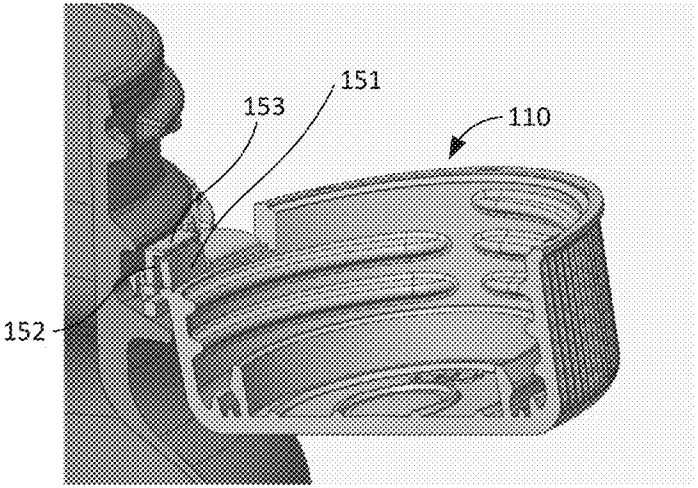
FIG. 1G is a cross section view of the hinged closure shown in FIG. 1F.
Figure 1H:
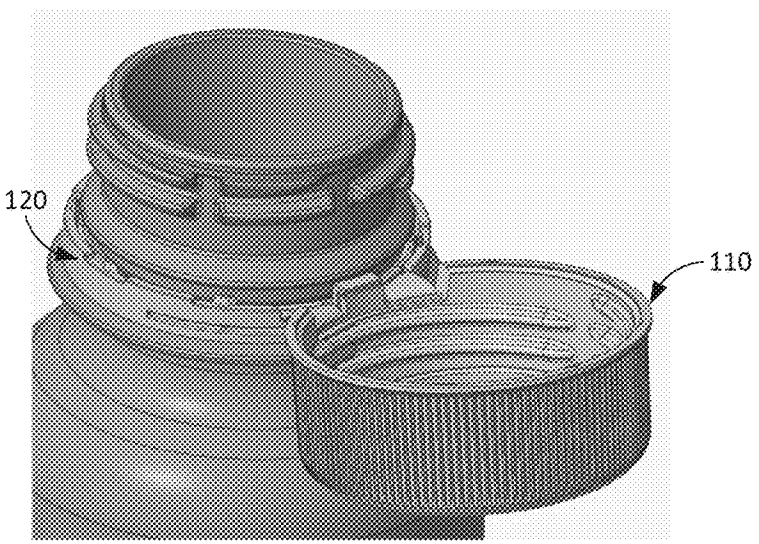
FIG. 1H is a top perspective view of the hinged closure in FIG. 1F.
Figure 1I:
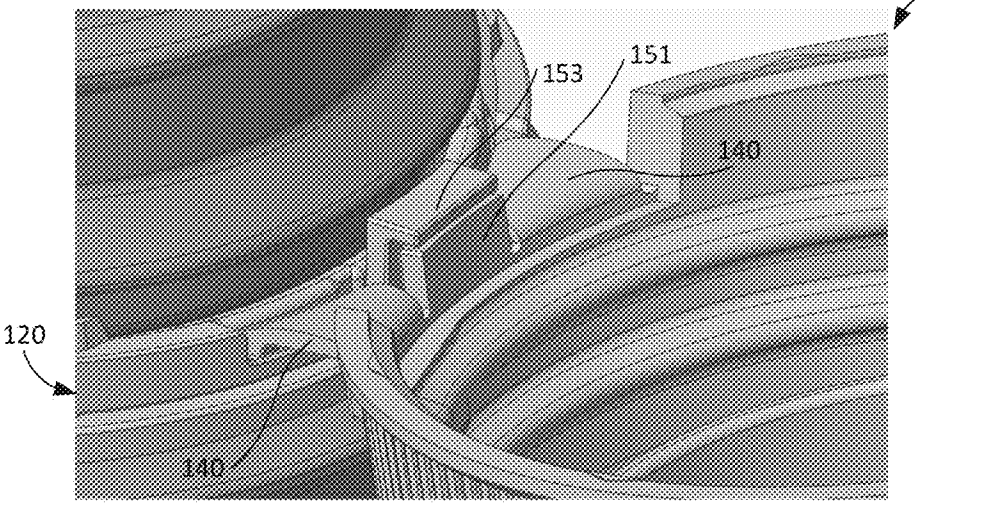
FIG. 1I is a close-up view of FIG. 1H showing the hinged closure in the open position, with the top tongue engaged with the protrusion of bottom tongue.

With reference now to FIGS. 1A-1D, an embodiment of the hinged closure 100 from various views is shown. FIG. 1A shows a perspective view; FIG. 1B provides a side view including the hinge portion 130; FIG. 1C is cross-sectional perspective view through a connecting column 140; FIG. 1D is a cross-sectional perspective view through a tongue 150. In this embodiment, the hinge portion 130 integrally connects the superior lid portion 110 with the inferior, ring-like skirt portion 120. The hinge portion 130 is a substantially H-shaped hinge comprising two connecting columns 140 on either side of a tongue 150. The connecting columns 140 may be vertical, as shown, and thus parallel to one another. Alternatively, at least a portion of the connecting columns 140 can be curved with respect to one another (e.g., crescent shaped). FIG. 1E is a side cross-sectional view of the hinged closure attached to a container 195 showing the lid portion 110 in the open position. FIG. 1F is a side view of an embodiments of the hinged closure 100 in the open position, attached to a container 195. FIG. 1G is a cross-section view of the hinged closure 100 shown in FIG. 1F. FIG. 1H is a top perspective view of the hinged closure in FIG. 1F, and FIG. 1I is a close-up view of FIG. 1H showing the hinged closure 100 in the open position, with the top tongue 151 engaged with the protrusion 153 of bottom tongue 152.

Figure 1J:
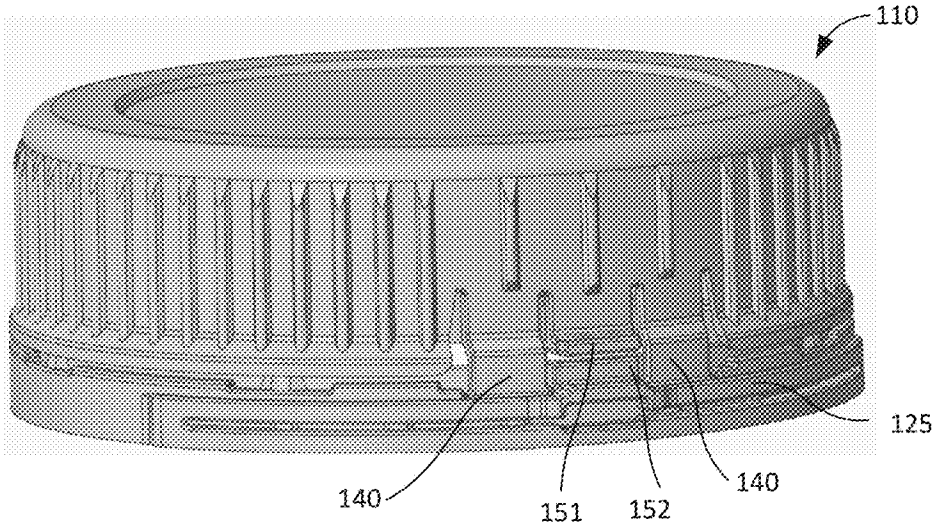
FIGS. 1J and 1K show another embodiment of the hinged closure in the closed and open positions, respectively. In this embodiment, the upper tongue engages with the tamper band to hold the hinged closure in the open position.
Figure 1K:
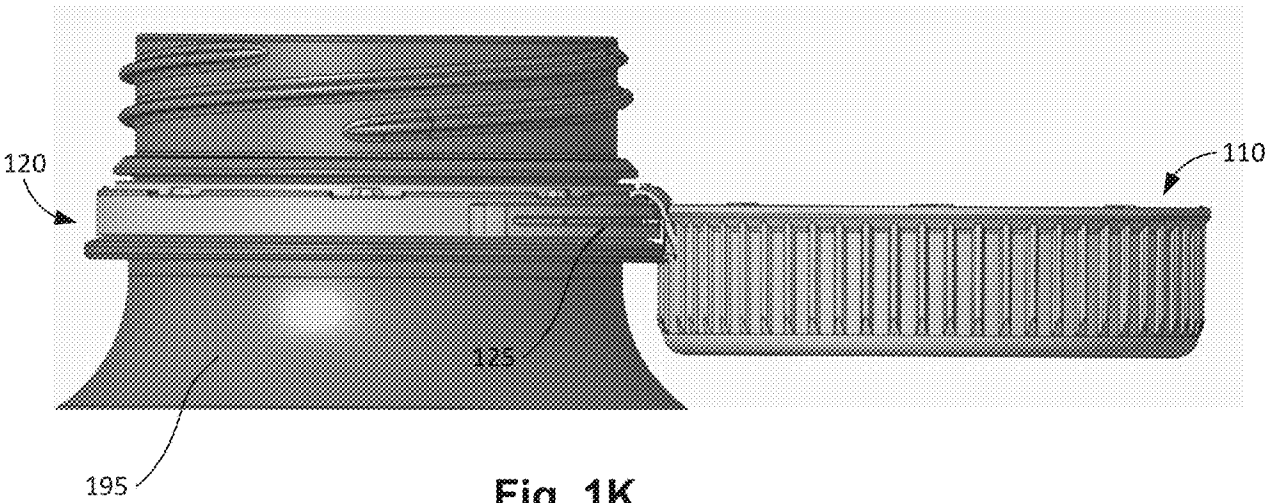
Figure 1L:
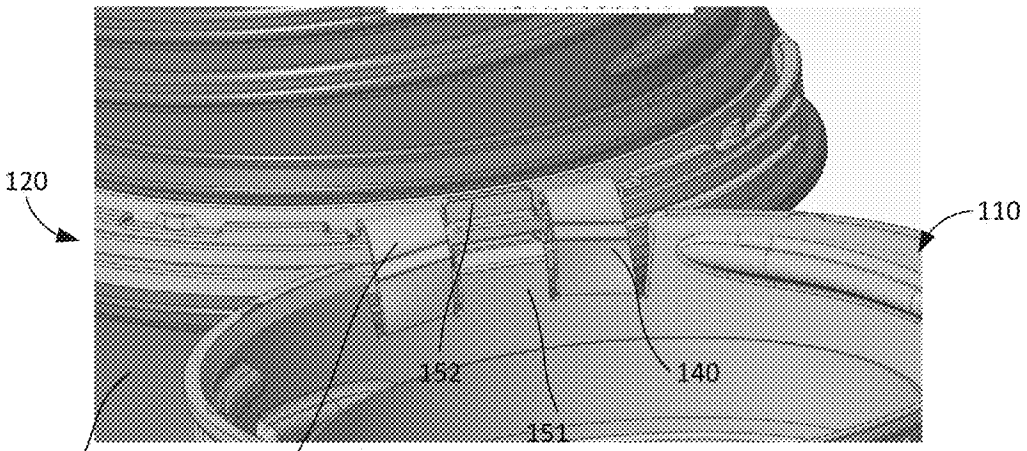
FIGS. 1L and 1M are top perspective views of the closure shown in the open position.
Figure 1N:
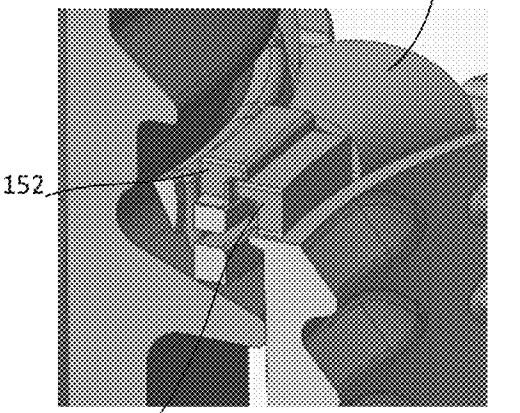
FIG. 1N shows a cross-section view of another embodiment of the hinged closure in an open position where the protrusion of the upper tongue engages with the protrusion of the lower tongue.
Figure 1M:
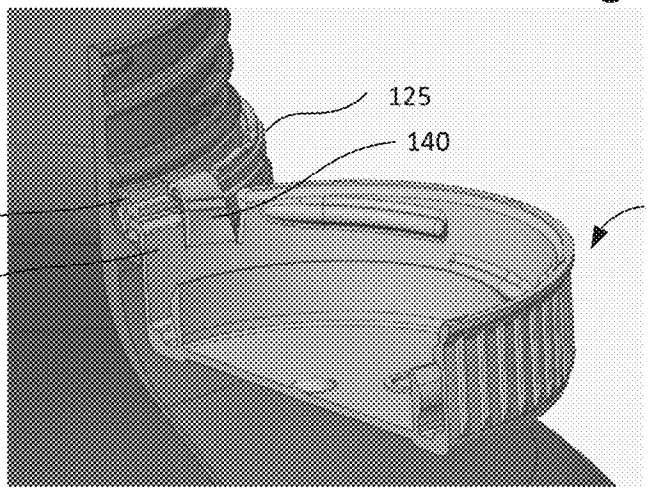

FIGS. 1J and 1K show an embodiment of hinged closure 100 in the closed and open positions, respectively. In this embodiment, the upper tongue 151 engages with the tamper band 125 to hold the hinged closure 100 in the open position. FIGS. 1L and 1M are top perspective views of the closure shown in the open position. FIG. 1M is a cross-section view.

In some embodiments, the upper tongue and lower tongue can engage with one another. For example, as shown in FIG. 1N, the upper tongue 151 and the lower tongue 152 each include a protrusion, similar to protrusion 153. In this embodiment, the protrusion from the lower tongue 152 engages with the protrusion of the upper tongue 152, when the closure is in the open position. Engagement of the protrusions on the respective tongues 151, 152 assists in securing the closures in the open position.

The connecting columns 140 are integrally joined at the top portion to the lid portion 110 and integrally joined at the bottom to the skirt portion 120. Each connecting column 140 includes a line of articulation 145 at the upper portion. In some embodiments, the line of articulation 145 can be horizontal to the long axis of the connecting column 140. In the particular embodiment shown in FIG. 1B, the line of articulation 145 is angled. One or more grooves 146 can be located above and/or below the line of articulation 145 to form a pinch area, which increases flexibility.

The tongue 150 is located between the two connecting columns 140. The tongue 150 and two connecting columns 140 can be in the same plane or in different planes (e.g. along a curved plane). The tongue 150 is divided by a cut into a top tongue 151 and a bottom tongue 152. The top tongue 151 is integrally joined to the lid portion 110 and bottom tongue 152 is integrally joined at the bottom to the skirt portion 120. In some embodiments, bottom tongue 152 is integrally joined at the bottom to a tamper band 125 included in the skirt portion 120. Either, or both, of the top tongue 151 and bottom tongue 152 can include an optional protrusion 153 configured to engage with the other tongue after opening of the closure 100 (FIGS. 1F-11). In some embodiments, the top tongue 151 or protrusion 153 can engage with the container when the closure 100 is open. For example, FIG. 1E shows a side cross-sectional view of the hinged closure 100 assembled with the container 195 and with the lid portion 110 in the open position, which is oriented to be between about 160-180 degrees relative to the lid portion in the closed position. As depicted, the top tongue 151 and/or protrusion thereof can engage with a portion of the container, for example a portion of the neck or a portion of a thread thereof, to maintain the lid portion in the open position. In example embodiments, the top tongue 151 is generally angled relative to the bottom tongue 152 when the lid portion is in the open position. In yet other embodiments, the top tongue 151 or protrusion 153 can engage with the tamper band 125 when the closure 100 is open (FIGS. 1J-1M). The open position in some embodiments may be greater than 180 degrees. Other optional features can also be included. For instance, bottom slitting 180 can be included in the skirt portion 120 to allow bending; additional material can be added as slit reinforcement 185 to bottom slitting 180; multiple bridges 160 can be added on the primary or secondary cut where needed during manufacture; the opening 190 between the lid portion 110 and the hinge portion 130 may be angled to prevent undercutting during molding (e.g., hinge portion 130 can be vertical or angled dependent on the technology utilized); and knurls 170 can be included to reinforce the strength of the hinged closure 100.

Figure 2A:
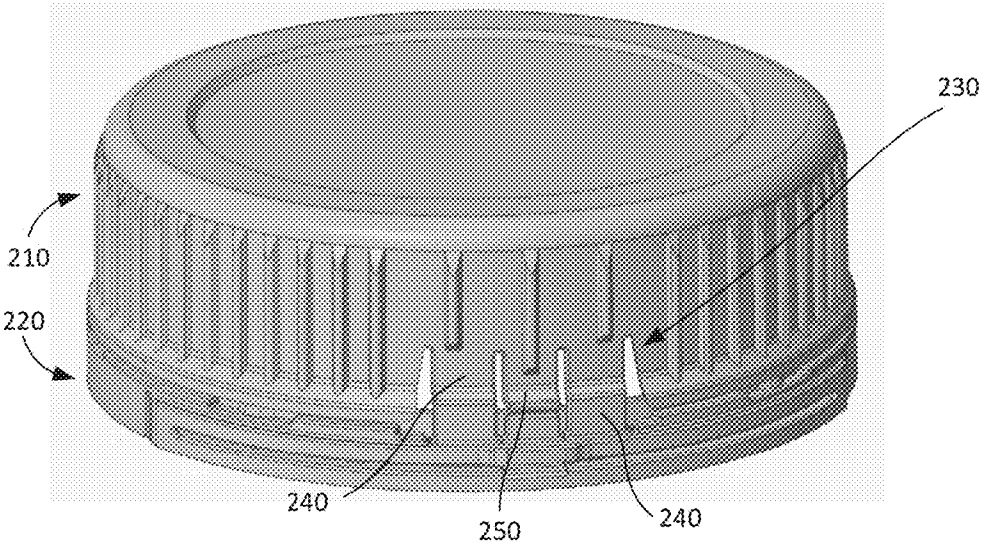
FIGS. 2A-2D provide another example of a hinged closure from various views in accordance with embodiments of the present disclosure, wherein the hinge portion comprises two connecting columns and a central tongue.
Figure 2B:
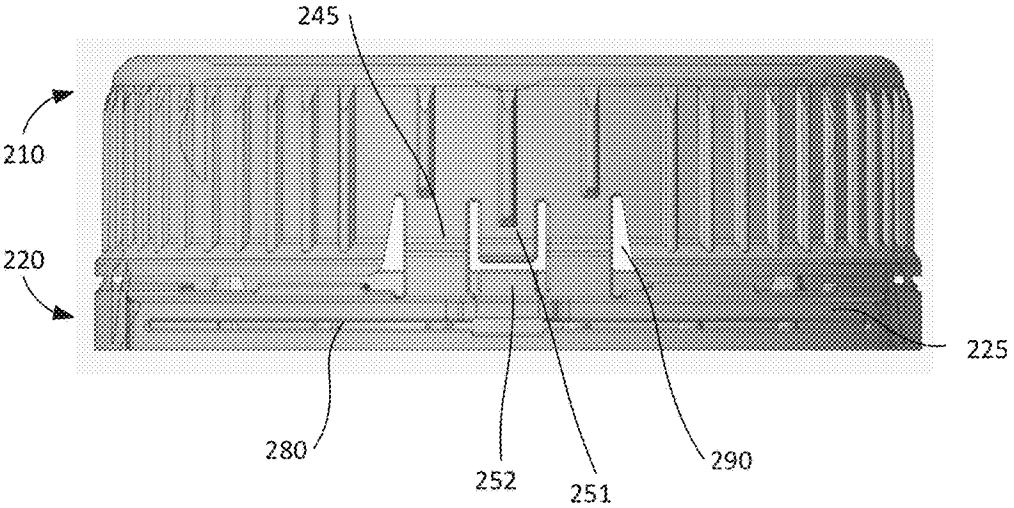
Figure 2C:
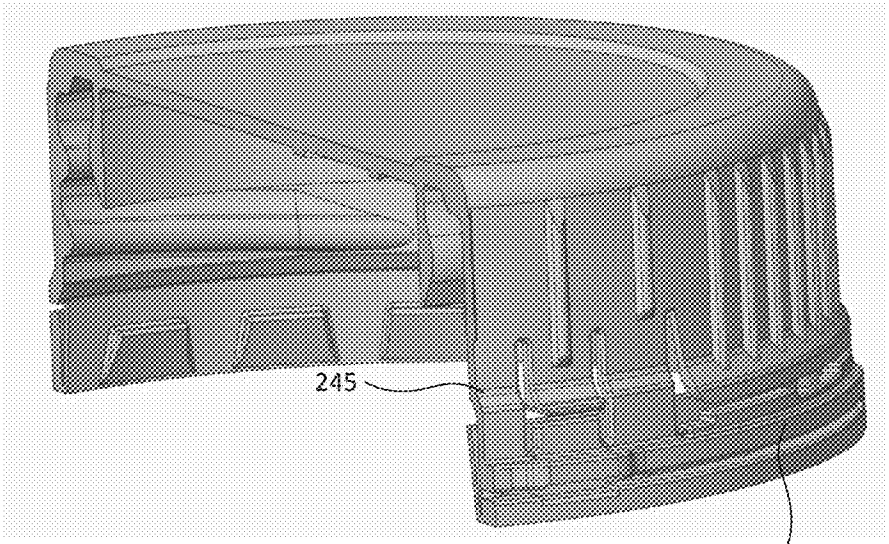
Figure 2D:
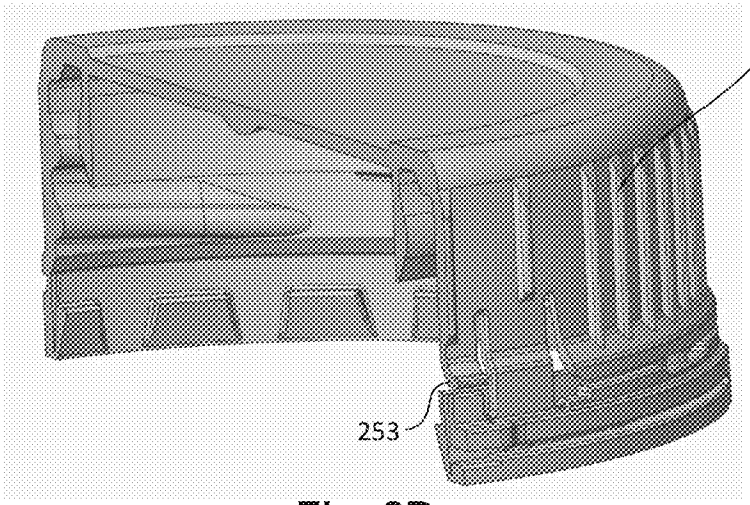
Figure 2G:
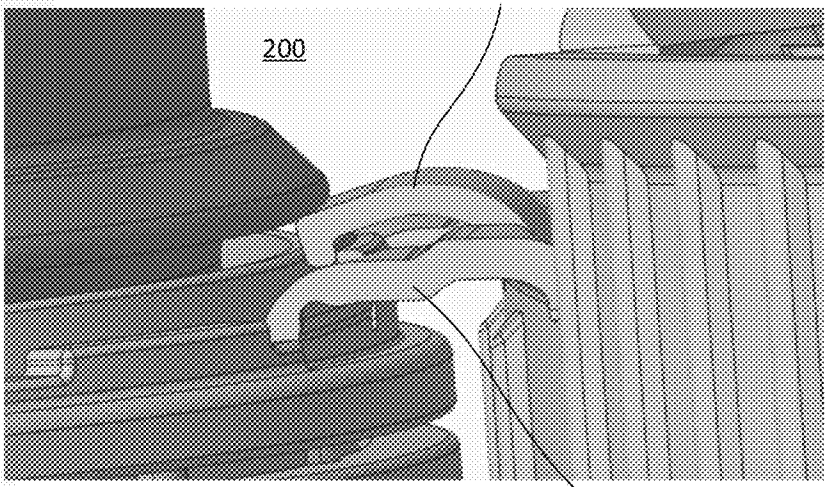
FIG. 2G is a close-up view of the hinged closure in the open position, with the top tongue engaged with the container neck.
Figure 2E:
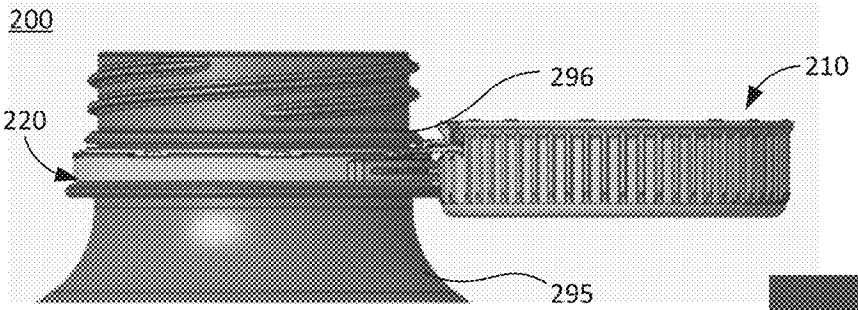
FIG. 2E is a side view of the hinged closure in the open position, attached to a container.
Figure 2F:
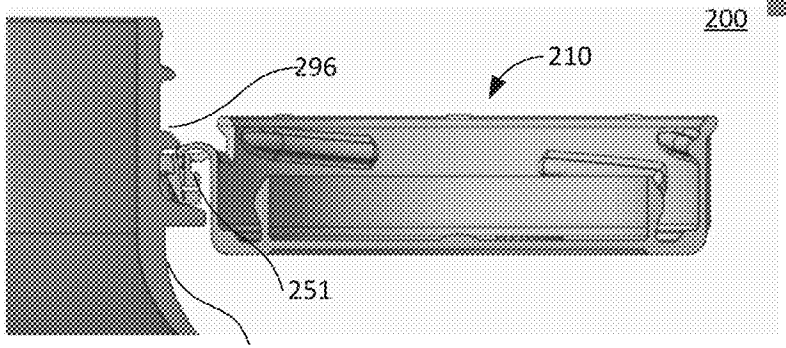
FIG. 2F is a cross-section view of the hinged closure shown in FIG. 2E.
Figure 2H:
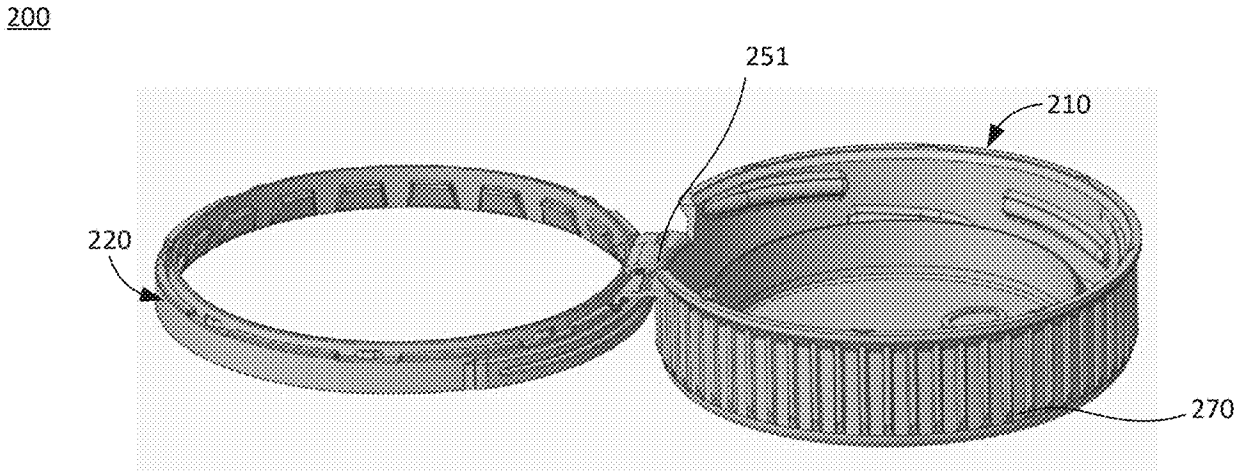
Figure 2I:
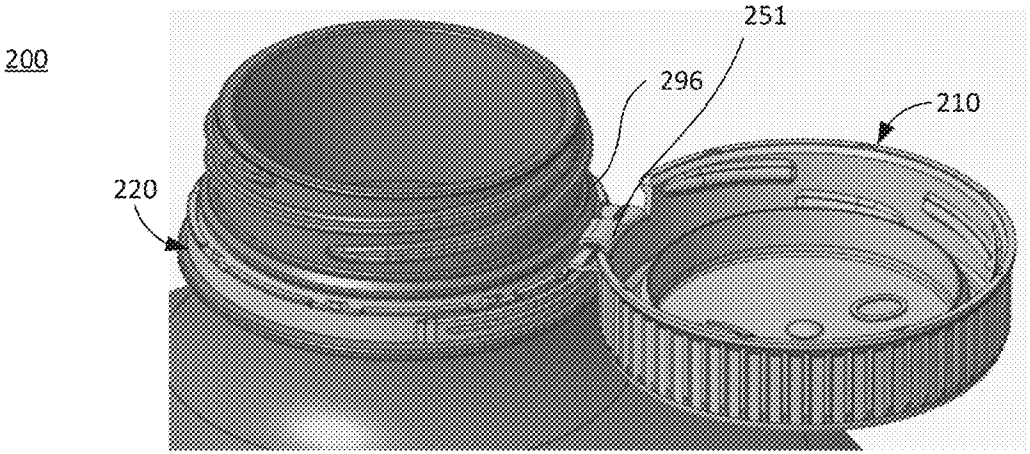

With reference now to FIGS. 2A-2D, an embodiment of the hinged closure 200 from various views is shown. FIG. 2A shows a perspective view; FIG. 2B provides a side view including the hinge portion 230; FIG. 2C is cross-sectional perspective view through a connecting column 240; FIG. 2D is a cross-sectional perspective view through a tongue 250. FIG. 2E is a side view of the hinged closure 200 in the open position, attached to a container 295. FIG. 2G is a cross section view of the hinged closure 200 shown in FIG. 2E. FIG. 2G is a close-up view of the hinged closure 200 in the open position, with the top tongue engaged with the container neck 296. FIGS. 2H and 21 are top perspective views of the closure shown in FIG. 2E, with and without the container, respectively. The hinge portion 230 integrally connects the superior lid portion 210 with the inferior, ring-like skirt portion 220. The hinge portion 230 is a substantially H-shaped hinge comprising two parallel connecting columns 240 on either side of a tongue 250. In other embodiments (not shown), at least a portion of the connecting columns 240 are curved with respect to one another (e.g., crescent shaped).

The connecting columns 240 are integrally joined at the top portion to the lid portion 210 and integrally joined at the bottom to the skirt portion 220. Each connecting column 240 includes a line of articulation 245 at the center portion. As shown in FIG. 2B, the line of articulation 245 can be horizontal to the long axis of the connecting column 240. In other embodiments, the line of articulation 245 can be angled.

The tongue 250 is located between the two connecting columns 240. The tongue 250 is divided by a cut into a top tongue 251 and a bottom tongue 252. The top tongue 251 is integrally joined to the lid portion 210 and bottom tongue 152 is integrally joined at the bottom to the skirt portion 220. The bottom tongue 252 is integrally joined at the bottom to a tamper band 225 included in the skirt portion 220. Either, or both, of the top tongue 251 and bottom tongue 252 can include an optional protrusion 253 configured to engage with the other tongue after opening. In some embodiments, the top tongue 251 or protrusion 253 can engage with the container neck finish when the closure is open. The open position in some embodiments may be greater than 180 degrees.

Similar to various other embodiments, such as those shown in FIGS. 1A-1D, other optional features can also be included. For example, bottom slitting 280 can be included in the skirt portion 220 to allow stretching during opening of the closure; additional material can be added as slit reinforcement 285 to bottom slitting 280; the opening 290 between the lid portion 210 and the hinge portion 230 may be vertical or angled to prevent undercutting during molding; and knurls 270 can be included to reinforce the strength of the hinged closure 200.

In some embodiments, such as those shown in FIGS. 2E-21, only the top tongue portion 251 is present. In these embodiments, the top tongue portion 251 engages with the container neck 296 (e.g., screw threads) to hold the lid in the open position. The top tongue portion 251 can be joined directly to the skirt portion 220 using breakable bridges that disconnect upon initial opening of the container 295. In some embodiments, the top tongue portion 251 is dimensioned such as to reduce any spacing that would exist between the upper tongue portion of the skirt 220.

Figure 3:
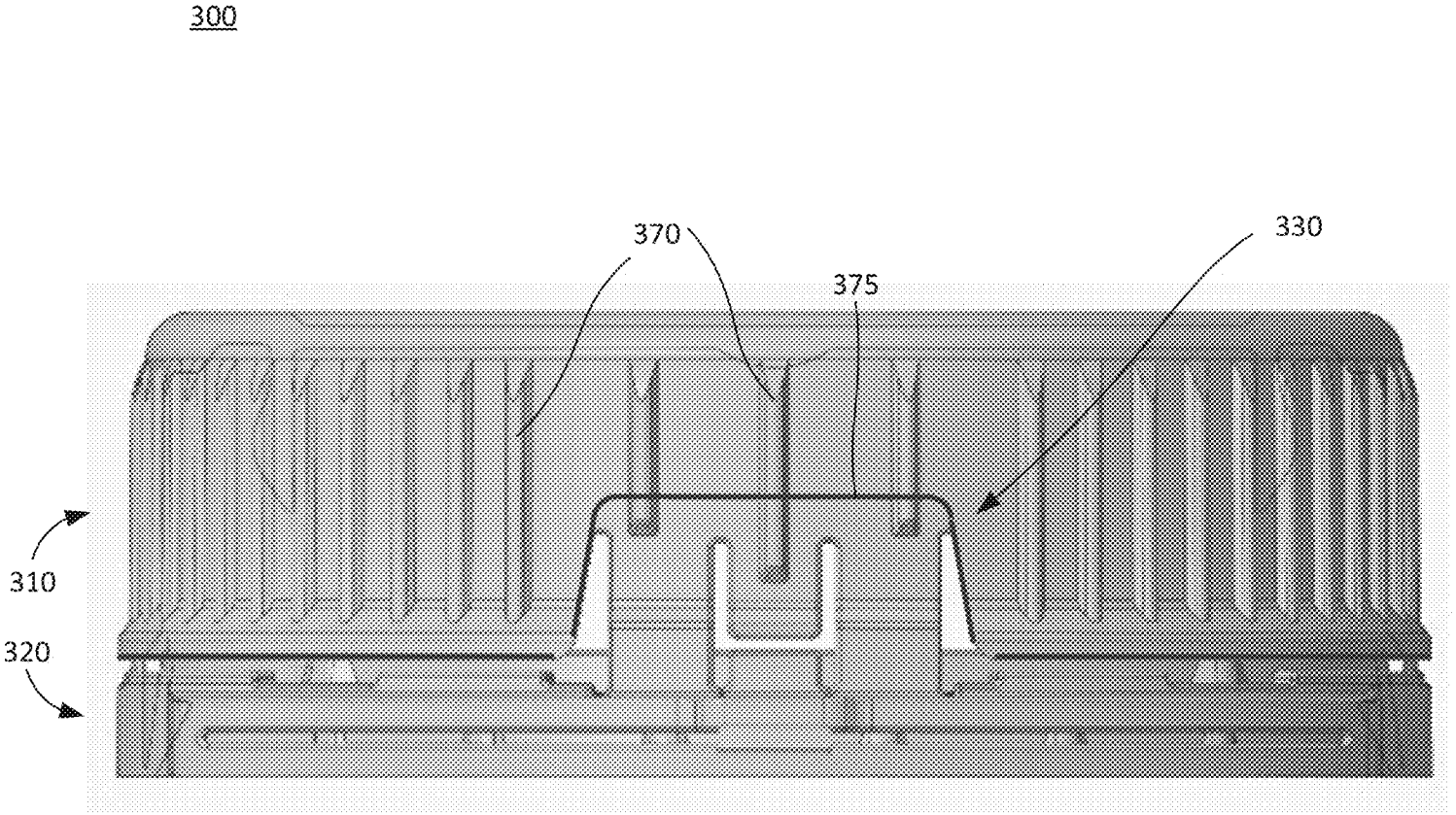
FIG. 3 provides a side view including the hinge portion, illustrating the mold split line, in accordance with embodiments of the present disclosure.

FIG. 3 provides a side view of a hinged closure 300 according to additional embodiments of the present disclosure. The parting line or split line 375 is oriented above the hinge portion 330 to include a portion of the knurls 370. This design allows for knurls 370 in which the hinge portion 330 will partially be molded by the slide to avoid any undercutting during injection molding of the hinged closure 300.

Figure 4A:
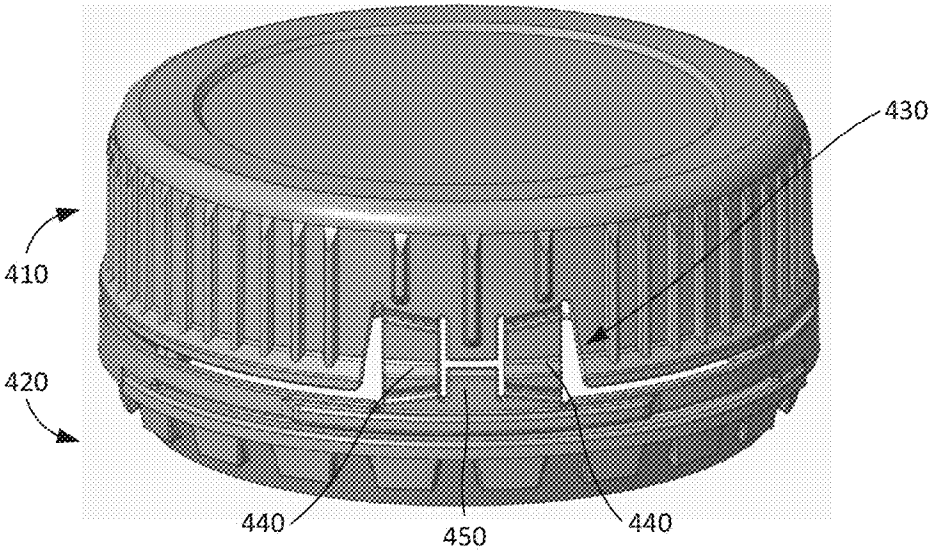
FIGS. 4A-4D provide another example of a hinged closure from various views in accordance with embodiments of the present disclosure, wherein the hinge portion comprises two connecting columns having two lines of articulation and a central tongue.
Figure 4B:
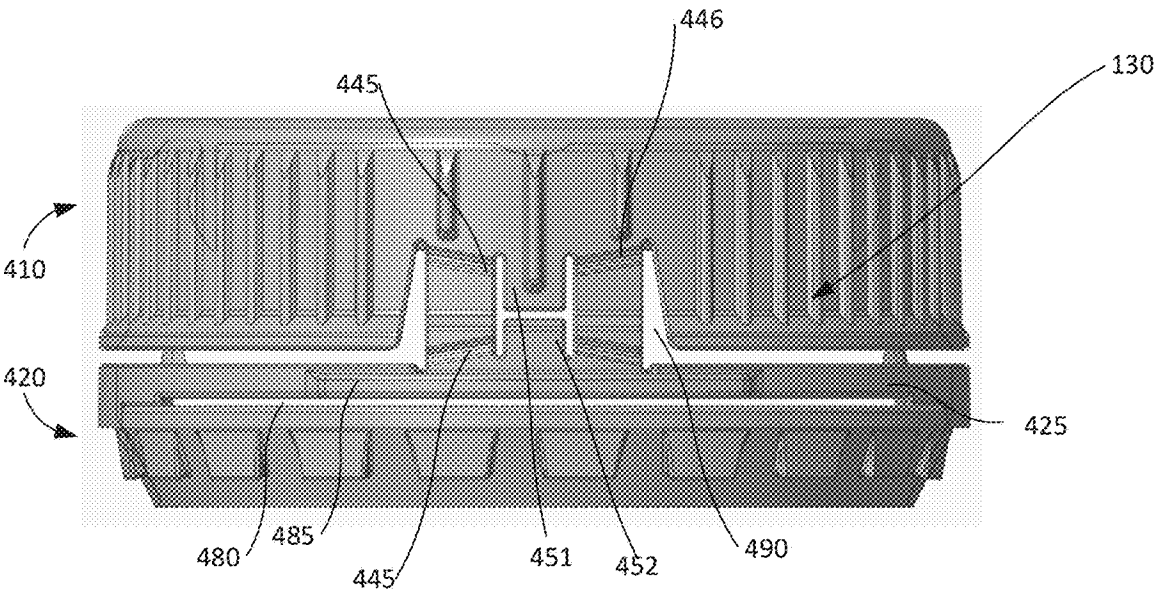
Figure 4C:
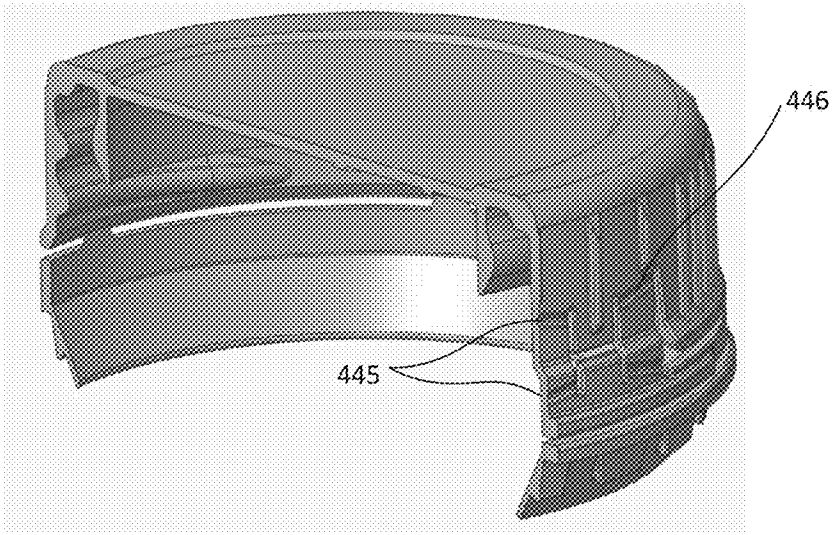
Figure 4D:
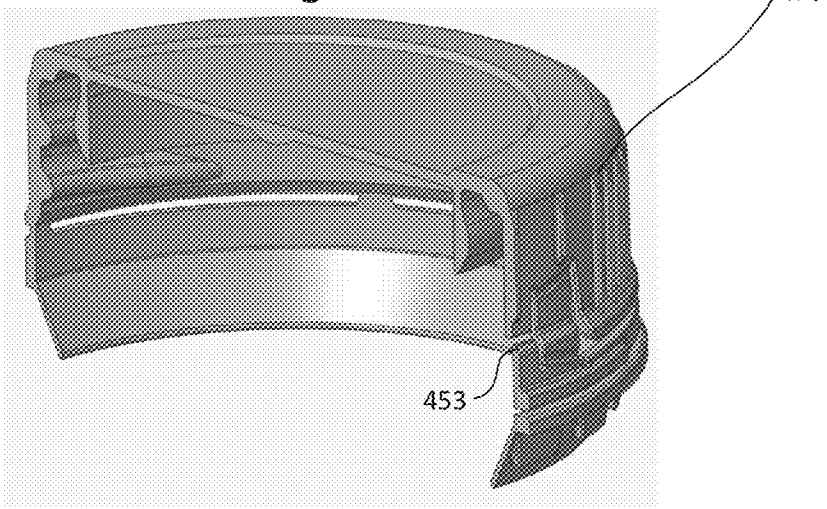

Turning to FIGS. 4A-4D, an embodiment of the hinged closure 400 from various views is shown. FIG. 4A shows a perspective view; FIG. 4B provides a side view including the hinge portion 430; FIG. 4C is cross-sectional perspective view through a connecting column 440; FIG. 4D is a cross-sectional perspective view through a tongue 450. In this embodiment, the hinge portion 430 integrally connects the superior lid portion 410 with the inferior, ring-like skirt portion 420. The hinge portion 430 is a substantially H-shaped hinge comprising two parallel connecting columns 440 on either side of a tongue 450. In other embodiments, at least a portion of the connecting columns are curved with respect to one another (e.g., crescent shaped).

The connecting columns 440 are integrally joined at the top portion to the lid portion 410 and integrally joined at the bottom to the skirt portion 420. Each connecting column 440 includes two lines of articulation 445, one at the upper portion and one at the lower portion. In some embodiments, the line of articulation 445 can be horizontal to the long axis of the connecting column 440. In the particular embodiment shown in FIG. 4B, the line of articulation 445 is angled. One or more grooves 446 can be located above and/or below the lines of articulation 445 to form pinch areas, which increases flexibility.

The tongue 450 is located between the two connecting columns 440. The tongue 450 is divided by a cut into a top tongue 451 and a bottom tongue 452. The top tongue 451 is integrally joined to the lid portion 410 and bottom tongue 452 is integrally joined at the bottom to the skirt portion 420. In some embodiments, bottom tongue 452 is integrally joined at the bottom to a tamper band 425 included in the skirt portion 420. Either, or both, of the top tongue 451 and bottom tongue 452 can include an optional protrusion 453 configured to engage with the other tongue after opening. In some embodiments, the top tongue 451 or protrusion 453 can engage with the container when the closure is open. The open position in some embodiments may be greater than 180 degrees.

As described in the above embodiments, other optional features can also be included. For example, bottom slitting 480 can be included in the skirt portion 420 to allow bending; additional material can be added as slit reinforcement 485 to bottom slitting 480; the opening 490 between the lid portion 410 and the hinge portion 430 may be angled to prevent undercutting during molding; and knurls 470 can be included to reinforce the strength of the hinged closure 400. In some embodiments (not shown), only the top tongue portion 451 is present. In these embodiments, the top tongue portion 451 engages with the container neck (e.g., screw threads) to hold the lid in the open position. The top tongue portion 451 can be joined directly to the skirt portion 420 using breakable bridges that disconnect upon initial opening of the container. In some embodiments, the top tongue portion 451 is dimensioned such as to reduce any spacing that would exist between the upper tongue portion of the skirt 420.

Figure 5A:
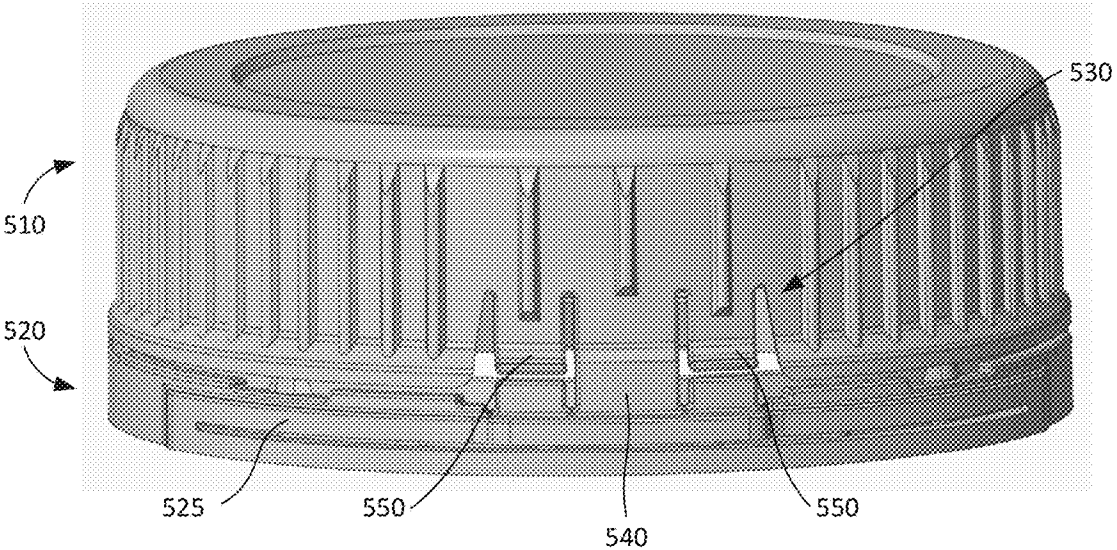
FIGS. 5A-5D provide another example of a hinged closure from various views in accordance with embodiments of the present disclosure, wherein the hinge portion comprises two tongues and a central connecting column having a single line of articulation.
Figure 5B:
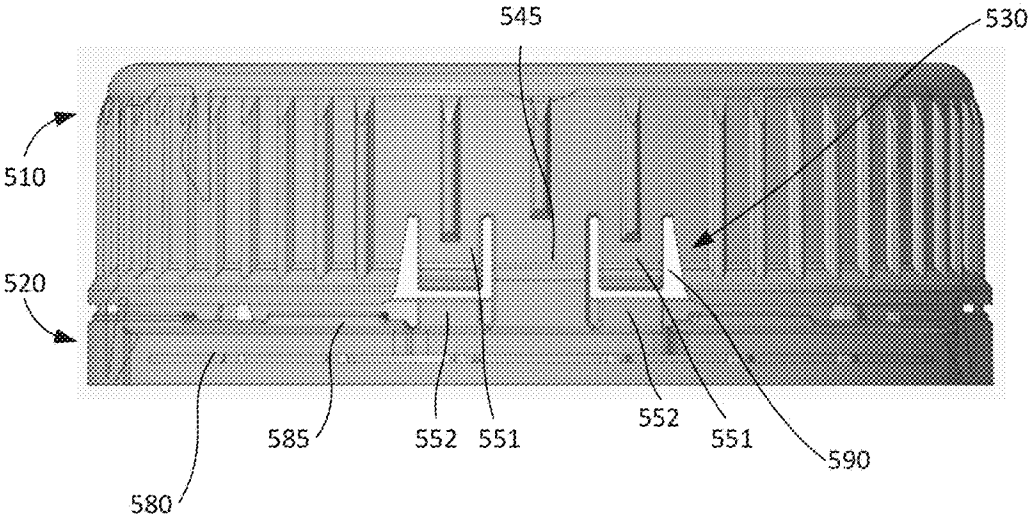
Figure 5C:
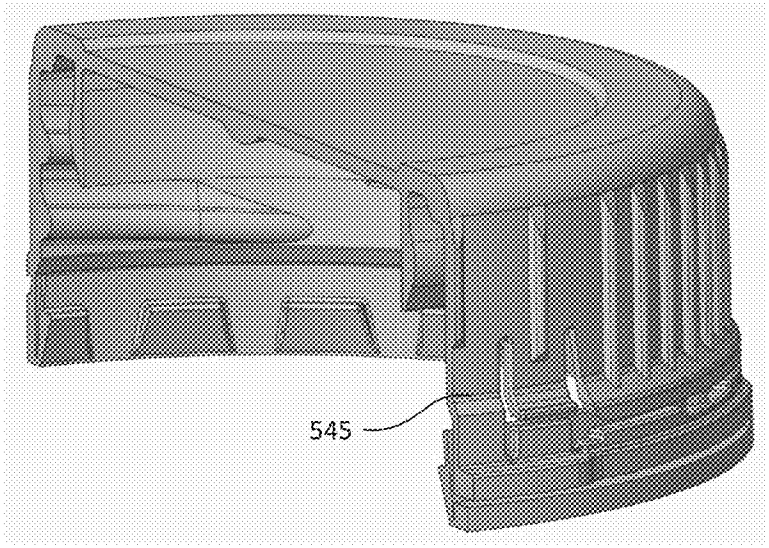
Figure 5D:
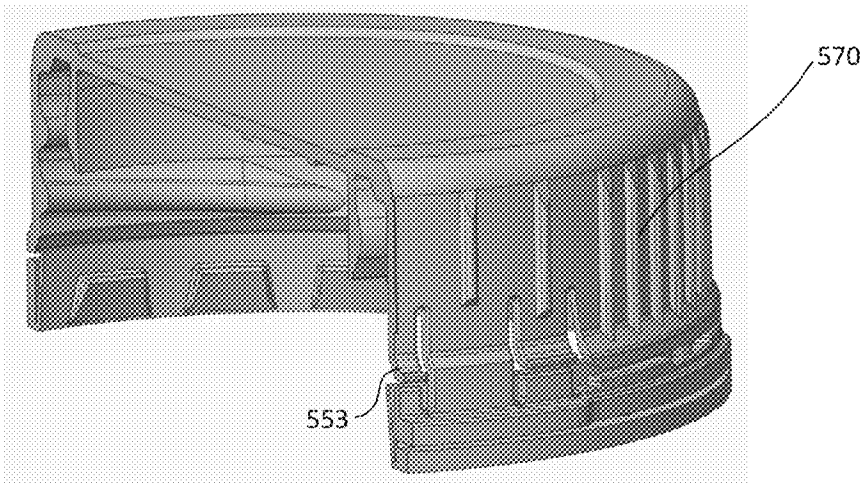

FIGS. 5A-5D, provides an alternative embodiment of the hinged closure 500 as shown in various views. FIG. 5A shows a perspective view; FIG. 5B provides a side view including the hinge portion 530; FIG. 5C is cross-sectional perspective view through a connecting column 540; FIG. 5D is a cross-sectional perspective view through a tongue 550. In this embodiment, the hinge portion 530 integrally connects the superior lid portion 510 with the inferior, ring-like skirt portion 520. The hinge portion 530 is substantially two H-shaped hinges comprising two parallel tongues 550 on either side of a single connecting column 540.

The connecting column 540 is integrally joined at the top portion to the lid portion 510 and integrally joined at the bottom to the skirt portion 520. The connecting column 540 includes a central line of articulation 545. In some embodiments, one or more grooves 546 (not shown) can be located above and/or below the lines of articulation 545 to form pinch areas, increasing flexibility. In this embodiment, the connecting column 540 may be wider than in embodiments having two connecting columns 540.

The connecting column 540 is located between the two tongues 550. The tongues 550 are each divided by a cut into a top tongue 551 and a bottom tongue 552. The top tongue 551 is integrally joined to the lid portion 510 and bottom tongue 552 is integrally joined at the bottom to the skirt portion 520. In some embodiments, bottom tongue 552 is integrally joined at the bottom to a tamper band 525 included in the skirt portion 520. Either or both of the top tongue 551 and bottom tongue 552 can include an optional protrusion 553 configured to engage with the other tongue after opening. In some embodiments, the top tongue 551 or protrusion 553 can engage with the container when the closure is open. The open position in some embodiments may be greater than 180 degrees.

As described in the above embodiments, other optional features can also be included. For example, bottom slitting 580 can be included in the skirt portion 520 to allow bending; additional material can be added as slit reinforcement 585 to bottom slitting 580; the opening 590 between the lid portion 510 and the hinge portion 530 may be angled to prevent undercutting during molding; and knurls 570 can be included to reinforce the strength of the hinged closure 500. In some embodiments (not shown), only the top tongue portion 551 is present. In these embodiments, the top tongue portion 551 engages with the container neck (e.g., screw threads) to hold the lid in the open position. The top tongue portion 551 can be joined directly to the skirt portion 520 using breakable bridges that disconnect upon initial opening of the container. In some embodiments, the top tongue portion 551 is dimensioned such as to reduce any spacing that would exist between the upper tongue portion of the skirt 520.

Although embodiments have been described herein in detail, the descriptions are by way of example. The features of the embodiments described herein are representative and, in alternative embodiments, certain features and elements may be added or omitted. Additionally, modifications to aspects of the embodiments described herein may be made by those skilled in the art without departing from the spirit and scope of the present invention defined in the following claims, the scope of which are to be accorded the broadest interpretation so as to encompass modifications and equivalent structures.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that measurements, amounts, and other numerical data can be expressed herein in a range format. It is also understood that there are a number of values disclosed herein, and that each value is also herein disclosed as "approximately" that particular value in addition to the value itself. For example, if the value "10" is disclosed, then "approximately 10" is also disclosed. Similarly, when values are expressed as approximations, by use of the antecedent "approximately," it will be understood that the particular value forms a further aspect. For example, if the value "approximately 10" is disclosed, then "10" is also disclosed.

As used herein, the terms "about," "approximately," "at or about," and "substantially equal" can mean that the amount or value in question can be the exact value or a value that provides equivalent results or effects as recited in the claims or taught herein. That is, it is understood that amounts, sizes, measurements, parameters, and other quantities and characteristics are not and need not be exact, but may be approximate and/or larger or smaller, as desired, reflecting tolerances, conversion factors, rounding off, measurement error and the like, and other factors known to those of skill in the art such that equivalent results or effects are obtained. In general, an amount, size, measurement, parameter or other quantity or characteristic is "about," "approximate," "at or about," or "substantially equal" whether or not expressly stated to be such. It is understood that where "about," "approximately," "at or about," or "substantially equal" is used before a quantitative value, the parameter also includes the specific quantitative value itself, unless specifically stated otherwise.

Where a range is expressed, a further aspect includes from the one particular value and/or to the other particular value. Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

For example, where the stated range includes one or both of the limits, ranges excluding either or both of those included limits are also included in the disclosure, e.g. the phrase "x to y" includes the range from 'x' to 'y' as well as the range greater than 'x' and less than 'y'. The range can also be expressed as an upper limit, e.g. 'about x, y, z, or less' and should be interpreted to include the specific ranges of 'about x', 'about y', and 'about z' as well as the ranges of 'less than x', less than y', and 'less than z'. Likewise, the phrase 'about x, y, z, or greater' should be interpreted to include the specific ranges of 'about x', 'about y', and 'about z' as well as the ranges of 'greater than x', greater than y', and 'greater than z'. In addition, the phrase "about 'x' to 'y'", where 'x' and 'y' are numerical values, includes "about 'x' to about 'y'".

It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a numerical range of "about 0.1% to 5%" should be interpreted to include not only the explicitly recited values of about 0.1% to about 5%, but also include individual values (e.g., about 1%, about 2%, about 3%, and about 4%) and the sub-ranges (e.g., about 0.5% to about 1.1%; about 5% to about 2.4%; about 0.5% to about 3.2%, and about 0.5% to about 4.4%, and other possible sub-ranges) within the indicated range.

What is claimed is:

1. A hinged closure for a container, comprising:

an upper lid portion comprising a top;

a lower skirt portion;

a hinge integrally interconnecting the upper lid portion and the lower skirt portion, the hinge comprising at least one connecting column, an upper tongue comprising an elongate body extending from the top along a longitudinal axis, the longitudinal axis being oriented perpendicularly relative to the top of the upper lid portion, the upper tongue having a protrusion at its distal end, and a lower tongue, the at least one connecting column defining a line of articulation so as to permit the hinging of the upper lid portion relative to the lower skirt portion;

wherein when in the closed position the upper tongue and the lower tongue are vertically oriented and coplanar, wherein when in the open position the closure is locked and the upper and lower tongues are angled relative to each other and wherein the upper lid portion is oriented to be between about 160 to 180 degrees relative to its orientation in the closed position, and wherein the protrusion is configured to engage with a distal end of the lower tongue or a container neck.

2. The hinged closure according to claim 1, wherein the hinge comprises two connecting columns adjacent to one another and the upper tongue and the lower tongue are positioned parallel between the two connecting columns, wherein the two connecting columns are vertical and parallel.

3. The hinged closure according to claim 1, wherein the hinge comprises two connecting columns adjacent to one another and the upper tongue and the lower tongue are positioned parallel between the two connecting columns, wherein the two connecting columns are curved with respect to one another.

4. The hinged closure according to claim 1, wherein the hinge comprises two tongues parallel to one another and one connecting column placed parallel between the two tongues.

5. The hinged closure according to claim 1, wherein the at least one connecting column comprises at least one line of articulation about which the upper lid portion rotates during an opening or closing operation.

6. The hinged closure according to claim 1, wherein the hinge rotates the lid portion relative to the skirt portion such that the lid portion can open greater than 180 degrees from a closed position.

7. The hinged closure according to claim 1, wherein upper tongue is integrally joined to the lid portion, and the lower tongue is integrally joined to the skirt portion.

8. The hinged closure according to claim 7, wherein the protrusion engages with the lower tongue or container neck in such a way to hold the lid in an open position.

9. The hinged closure according to claim 8, wherein the protrusion overlaps the lower tongue to hold the lid in an open position.

10. The hinged closure according to claim 8, wherein the lower tongue has a protrusion at its distal end and the protrusion of the lower tongue is configured to engage with the protrusion of the upper tongue to hold the lid in an open position.

11. The hinged closure according to claim 1, wherein the tongue comprises an upper tongue integrally joined to the lid portion, and wherein the upper tongue is configured to engage with a container neck.

12. The hinged closure according to claim 1, wherein, in addition to the hinge, the upper lid portion and lower skirt portion are separably joined by frangible bridges.

13. The hinged closure according to claim 1, wherein the closure is formed by injection molding in a single piece.

14. A hinged closure for a container, comprising:

an upper lid portion;

a lower skirt portion;

a hinge integrally interconnecting the upper lid portion and the lower skirt portion, the hinge comprising at least two spaced apart connecting columns, an upper tongue defining an elongate member that perpendicularly extending relative to a top surface of the upper lid portion, the upper toque comprising a protrusion at its distal end, and a lower tongue, the upper and lower tongues being positioned between the at least two connecting columns and the at least two connecting columns being positioned symmetrically relative thereto;

wherein when in the closed position the upper tongue and the lower tongue are vertically oriented and coplanar, wherein when in the open position the closure is locked and the upper and lower tongues are angled relative to each other, wherein the protrusion is configured to engage with a distal end of the lower tongue or a container neck; and wherein the closure is a screw closure.

15. The hinged closure according to claim 14, wherein the lower skirt portion comprises a horizontal slit below the lower tongue.

16. A hinged closure for a container, comprising:

an upper lid portion;

a lower skirt portion; and a hinge integrally interconnecting the upper lid portion and the lower skirt portion, the hinge comprising a pair of spaced apart connecting columns, an upper tongue defining a body extending along a longitudinal axis that is generally parallel with the extension of the spaced apart connecting columns, wherein the longitudinal axis is oriented perpendicularly relative to a top surface of the upper lid portion, the upper toque comprising a protrusion at its distal end, and a lower tongue, the upper and lower tongue being positioned between the connecting columns, the connecting columns being vertically oriented, wherein when in the closed position the upper tongue and the lower tongue are generally vertically oriented and coplanar relative thereto, wherein when in the open position the hinge closure is locked and the upper and lower tongues are generally angled relative to each other, and wherein the protrusion is configured to engage with at least a portion of a container neck or a distal end of the lower tongue.

17. The hinged closure for a container of claim 16, wherein the lower skirt portion defines a center, wherein outermost sides of the connecting columns relative to the center define an included angle of less than 60 degrees.

18. The hinged closure for a container of claim 16, wherein the lower skirt portion comprises an outer and an inner peripheral surface and opposing end surfaces, and wherein at least a portion of the pair of spaced apart columns integrally join an end surface of the lower skirt portion and transversely extend therefrom.

19. The hinged closure for a container of claim 16, wherein the lower skirt portion defines an opening extending between outer and inner peripheral surfaces thereof, the opening defining a slit so as to permit upward displacement of a portion of the lower skirt portion as the upper lid portion is moved from the closed position to the open position.

* * * * *